US008333524B2

(12) United States Patent
Bandholz et al.

(10) Patent No.: US 8,333,524 B2
(45) Date of Patent: Dec. 18, 2012

(54) CARTRIDGE WITH RIBBON BACK-TENSION

(75) Inventors: Brent A. Bandholz, Hubertus, WI (US); Richard L. Carriere, Oak Creek, WI (US); Robert J. Godfrey, Baraboo, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 559 days.

(21) Appl. No.: 12/482,814

(22) Filed: Jun. 11, 2009

(65) Prior Publication Data

US 2009/0311025 A1 Dec. 17, 2009

Related U.S. Application Data

(60) Provisional application No. 61/061,460, filed on Jun. 13, 2008.

(51) Int. Cl.
*B41J 33/00* (2006.01)

(52) U.S. Cl. ..... 400/234; 400/231

(58) Field of Classification Search ..... 400/224.2, 400/231, 234; 347/214
See application file for complete search history.

(56) References Cited

U.S. PATENT DOCUMENTS

| | | | | |
|---|---|---|---|---|
| 4,408,913 | A | 10/1983 | Frechette | |
| 4,883,234 | A | 11/1989 | Yamakawa et al. | |
| 5,638,104 | A | 6/1997 | Suzuki et al. | |
| 5,667,318 | A * | 9/1997 | Tanno et al. | 400/208 |
| 5,835,118 | A | 11/1998 | Fisher, Sr. et al. | |
| 6,623,192 | B1 * | 9/2003 | Kameyama | 400/208 |
| 6,788,324 | B2 * | 9/2004 | Fisher et al. | 347/188 |
| 2006/0269346 | A1 * | 11/2006 | Takayama | 400/613 |

FOREIGN PATENT DOCUMENTS

| | | | |
|---|---|---|---|
| EP | 0377256 | A | 7/1990 |
| EP | 0475404 | A | 3/1992 |
| EP | 1000765 | A | 5/2000 |
| EP | 1769934 | A | 4/2007 |
| JP | 11058866 | * | 3/1999 |

OTHER PUBLICATIONS

International Search Report; PCT/US2009/047081; Sep. 18, 2009; 5 pages.

* cited by examiner

*Primary Examiner* — Judy Nguyen
*Assistant Examiner* — Blake A Tankersley
(74) *Attorney, Agent, or Firm* — Quarles & Brady LLP

(57) ABSTRACT

The present invention provides a cartridge providing ribbon tension. The cartridge includes a cartridge housing having walls. A first spool and a second spool are contained in at least in part in the cartridge and have a ribbon extending therebetween. The first spool and the second spool extend between a pair of ends with at least one of the pair of ends having a driving portion. At least one resistance-applying part extends around a portion of each of the first spool and the second spool. The first spool and the second spool have a loaded and an unloaded position. In the loaded position, at least one of the resistance applying part is disengaged from the walls of the cartridge. In the unloaded position, at least one resistance-applying part engages the walls of the cartridge.

13 Claims, 10 Drawing Sheets

CARTRIDGE WITH RIBBON BACK-TENSION

CROSS-REFERENCE TO RELATED APPLICATION

This application claims the benefit of U.S. Provisional Patent Application No. 61/061,460 filed Jun. 13, 2008, the disclosure of which is hereby incorporated by reference in entirety.

STATEMENT OF FEDERALLY SPONSORED RESEARCH OR DEVELOPMENT

Not applicable.

BACKGROUND OF THE INVENTION

This invention relates to printers. In particular, this invention relates to thermal transfer printers for the printing of labels.

In thermal transfer printers, a thermal print head is heated to selectively transfer melted ink onto a print media such as a label. In many printers, the ink may be carried by a ribbon substrate that is fed from a supply spool, past the thermal print head, and onto a rewind spool. As the ribbon is consumed during the printing process and may need to be replaced, the ribbon cartridge is a consumable good that can be removably loaded into the printer.

It is desirable to avoid slack in the ribbon, both when the printer is in use and when the printer is between uses (i.e., sitting and ready to print, being reloaded with print media, being subjected to other maintenance, and the like). If during the printing or feeding process the ribbon has slack in it, then a crease or wrinkle may develop in the ribbon that will result in print defects. Additionally, if there is too much slack in the ribbon, the ribbon could unintentionally drag on the print media resulting in skidding.

During a printing or rewind operation, as the ribbon passes the thermal print head, static electricity can be generated. When the ribbon is removed from contact with the platen roller or print media, the static electricity between the ribbon and the platen roller or print media can cause the ribbon to unwind from the supply and rewind spools. Thus, the drive mechanism that drives the operation of the printer (and the passage of ribbon from the supply to the rewind spools) may include gears and/or tensioning mechanisms to maintain appropriate tension across the ribbon both during printing, feeding, and between print jobs.

However, in some printer configurations, when the printer is not in use, the ribbon cartridge may temporarily become disengaged from the tensioning mechanisms during reloading of print media or other maintenance. When this happens, the ribbon can unwind resulting in aforementioned problems during subsequent printing.

One method of reducing slack in the ink ribbon between printer uses (i.e., either between print jobs if tensioning mechanisms are not present in the drive mechanism or when the ribbon cartridge is disengaged from the drive mechanism) is to increase the frictional forces required to rotate the supply and rewind spools or rewind spools within the ribbon cartridge. However, the frictional force that is used to prevent unwinding of the ribbon from the spools must also be overcome during the rotation of the ribbon. Accordingly, this increases the power requirement of the motor. Providing a motor that meets the increased power requirements is undesirable, as doing so increases the cost and reduces the efficiency of the printer.

Hence, a need exists for a ribbon cartridge that maintains tension so that the ribbon does not unwind when the cartridge is not in use. Moreover, there is a need to provide a ribbon cartridge that does not require a motor with increased power requirements to overcome a frictional force to provide the ribbon tension.

SUMMARY OF THE INVENTION

The present invention provides a cartridge providing ribbon tension. The cartridge includes a cartridge housing having walls. A first spool and a second spool are contained in at least in part in the cartridge and have a ribbon extending therebetween. The first spool and the second spool extend between a pair of ends with at least one of the pair of ends having a driving portion. At least one resistance-applying part extends around a portion of each of the first spool and the second spool. The first spool and the second spool have a loaded and an unloaded position. In the loaded position, at least one of the resistance applying part is disengaged from the walls of the cartridge. In the unloaded position, at least one resistance-applying part engages the walls of the cartridge.

According to one aspect of the invention, the resistance-applying part extends around a portion of each of the first spool and the second spool and is a plurality of o-rings. The plurality of o-rings may be made of rubber or an elastomeric material. The first spool and the second spool may each have two o-rings on opposite sides of a section of the first spool and the second spool for receiving the ribbon. Additionally, the first spool and the second spool may have a plurality of retaining channels for receiving the plurality of o-rings.

According to other aspects of the invention, the driving portion on at least one of the first spool and the second spool is a gear. Moreover, a gear train may engage the driving portion of at least one of the first spool and the second spool to selectively drive the cartridge.

According to yet another aspect of the invention, a print head may be located between the first spool and the second spool such that the print head can print using the ribbon extending between the first spool and the second spool. The print head may be a thermal print head and the ribbon may be an ink ribbon for a thermal transfer printing operation.

According to another form of the invention, a printer is provided. The printer includes a print assembly frame including an upper print frame and a lower print frame. The upper print frame is configured to receive a ribbon cartridge. A saddle is formed in the lower print frame, with the saddle being configured to receive a ribbon cartridge.

According to one aspect of the invention, the printer further includes a ribbon cartridge releaseably inserted into the upper print frame. The ribbon cartridge has a structure similar to the ribbon cartridges described above. When the upper print frame and the lower print frame are moved into a closed position the first spool and the second spool are supported by the saddle in the lower print frame to place the first spool and the second spool in the loaded position.

Thus, the present invention provides a cartridge that maintains ribbon tension in a variety of positions. When placed in a print assembly, the spools can be easily rotated when the cartridge is loaded into the print assembly. However, when the cartridge is removed from the print assembly (or moved to a position in which a tensioning mechanism of a gear train no longer provides tension on the ribbon), the spools drop by gravity, such that the resistance between the resistance-applying portion of spools and the inner wall of the cartridge housing provide a sufficient frictional force to prevent unwinding of the ribbon.

These and still other advantages of the invention will be apparent from the detailed description and drawings. What follows is merely a description of a preferred embodiment of the present invention. To assess the full scope of the invention the claims should be looked to as the preferred embodiment is not intended to be the only embodiment within the scope of the claims.

DETAILED DESCRIPTION OF THE PREFERRED EMBODIMENT

Figure 1:
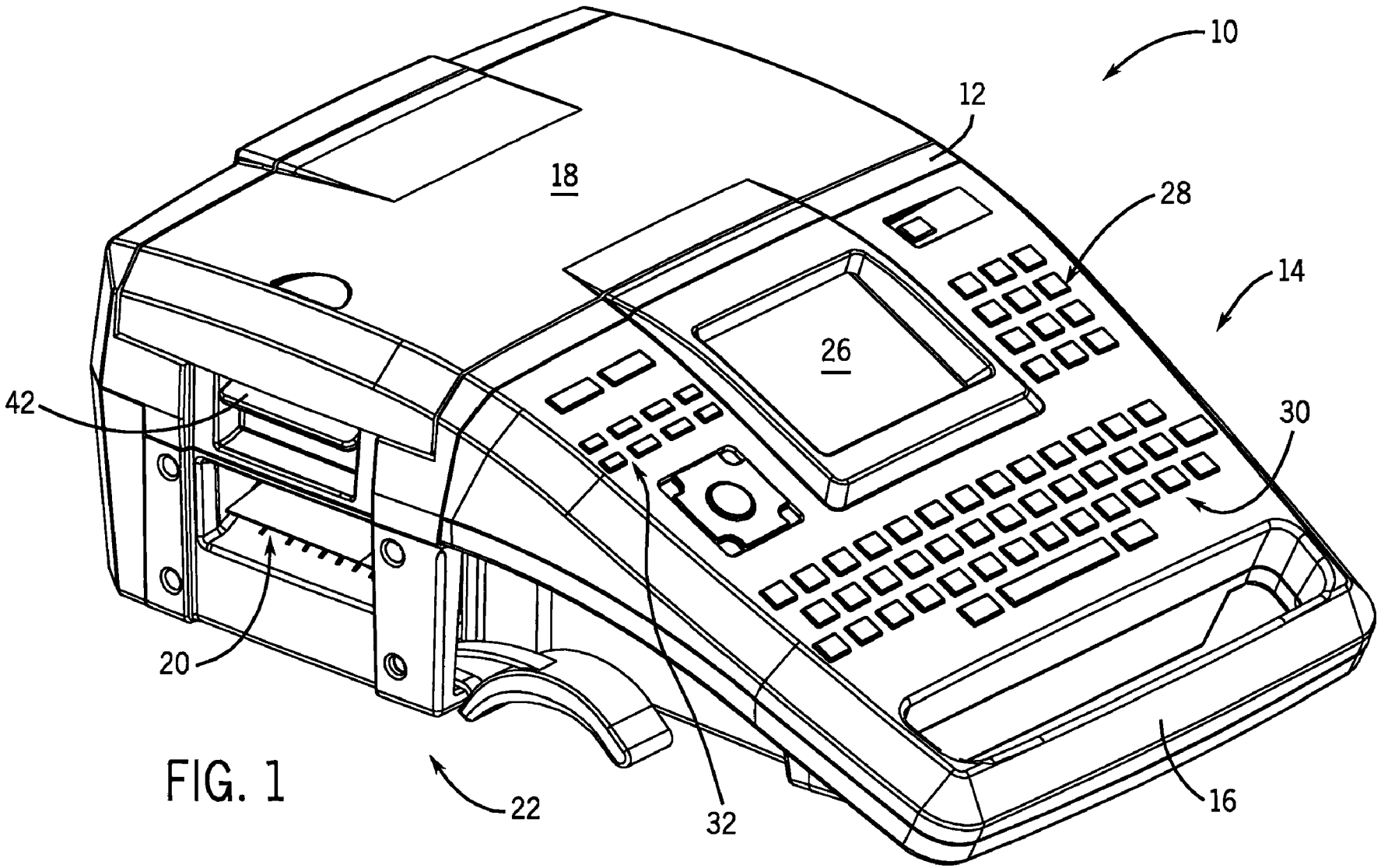
FIG. 1 is a front side perspective view of a printer.

Referring now to FIG. 1, a printer 10 incorporating the present invention for the printing of labels is shown. The printer 10 has a body 12 including a user interface 14, a handle 16 for easy transport of the printer 10, a moveable cover 18 for accessing a print assembly transversely mounted within the body 12 of the printer 10, a print slot 20 that dispenses the printed labels out of the printer 10, and a cutting assembly 22 for the cutting or separation of printed labels. It should be appreciated that the printer 10 may be operable when oriented in directions other than that shown in FIG. 1. For example, the printer 10 may be placed on its side or with the handle 16 directed up.

The user interface 14 allows the user to input data for printing on a label and commands for controlling the printer 10. The user interface 14 may include, but is not limited to, a display 26 for the display of entered data or prompting of user input, a keypad 28 and a keyboard 30 for entering data, and function buttons 32 that may be configured to perform various functions typical to printing (i.e., power on/off, forward feed, stop printing, and the like) or can be programmable for the execution of user-defined macros.

The user interface 14 may be supplemented by or replaced by other forms of data entry or printer control. For example, a separate data entry and control module may be linked wirelessly or by a data cable to the printer 10. The data entry and control module can include a computer, a router, and the like, without departing from the scope of the invention.

Figure 2:
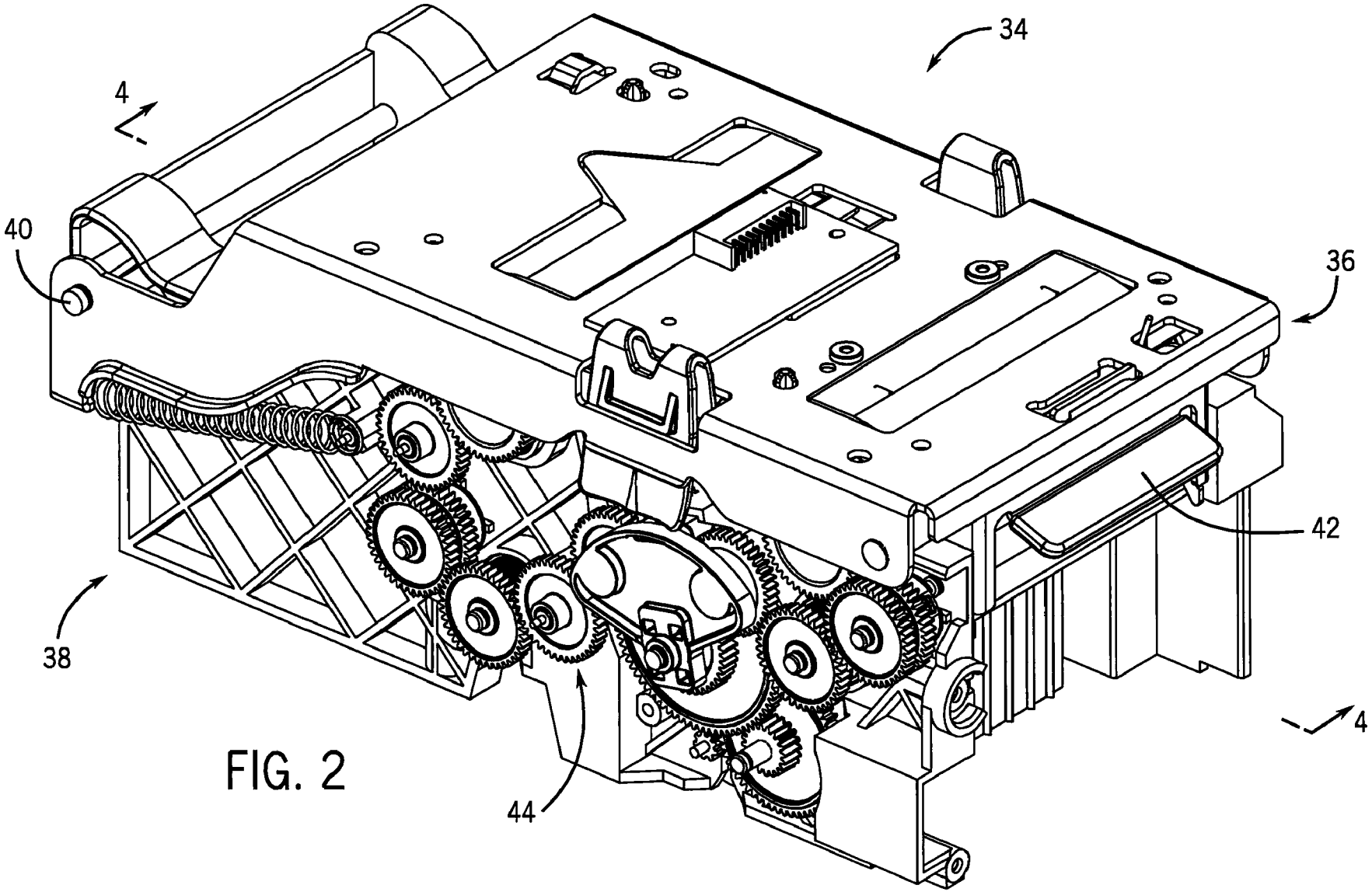
FIG. 2 is a perspective view of a print assembly contained within the printer of FIG. 1 with the print assembly in a closed position.

Referring now to FIG. 2, a print assembly 34 is shown after having been removed from the inside of the printer 10. This print assembly 34 is mounted transversely in the printer body and includes an upper print frame 36 and a lower print frame 38. On the rear side of the print assembly 34, the upper print frame 36 and the lower print frame 38 are pivotally connected at a hinge 40. On the front side of the print assembly 34, a latch 42 releaseably secures the upper print frame 36 and the lower print frame 38 together.

The print assembly 34 can be in an opened or a closed position. In the view shown in FIG. 2, the print assembly 34 is in the closed position. In this view, the upper print frame 36 and the lower print frame 38 are held together by the hinge 40 on one side and the latch 42 on the other side. In the view shown in FIG. 3, the print assembly is in the opened position. In this position, the latch 42 is released such that the upper print frame 36 and the lower print frame 38 can be moved apart from one another to provide easy access to the internal components of the print assembly 34. It should be noted that while a hinged assembly has been described, that other structures for holding an upper print frame to a lower print frame are contemplated.

In some forms of the invention, the upper print frame 36 may be secured to the moveable cover 18 and the latch 42 may be accessible from the exterior of the printer 10. In this way, when the latch 42 is released to allow the upper print frame 36 to pivot relative to the lower print frame 38, the upper print frame 36 and the moveable cover 18 move together so as to minimize the steps necessary to open the printer 10 and access the interior for the replacement of consumables or other maintenance operations.

Figure 3:
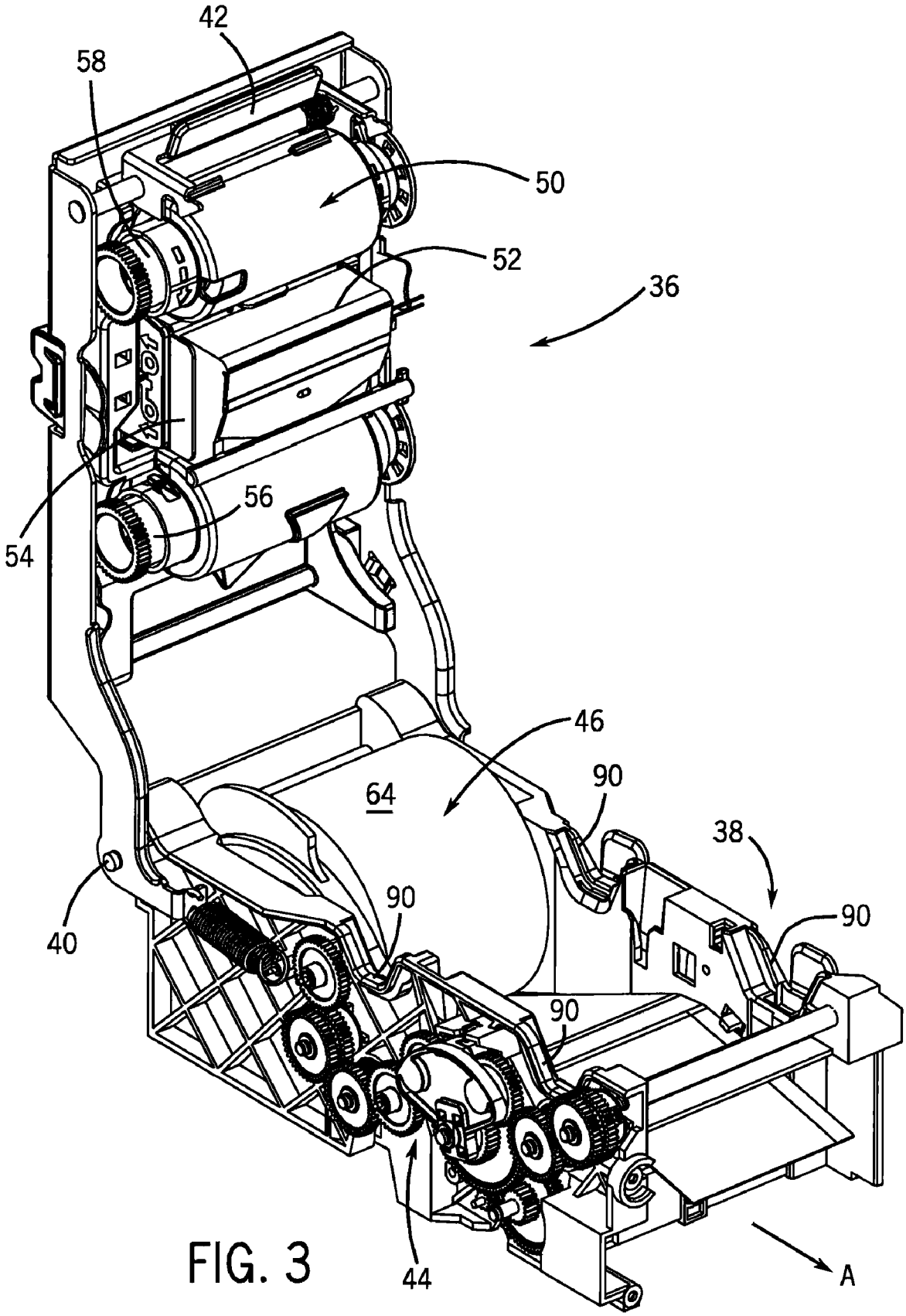
FIG. 3 is a perspective view of the print assembly of FIG. 2 in an opened position.

Referring now to FIG. 3, the print assembly 34 is shown after the latch 42 has been released to allow the upper print frame 36 to pivot away from the lower print frame 38, thus moving the print assembly 34 into the opened position and exposing the interior of the print assembly 34. On the inside of the print assembly 34, a roll assembly 46 has been loaded into the lower print frame 38. The roll assembly 46 carries a print media, such as, for example, labels, thereupon.

In the opened position, the internal components attached to the upper print frame 36 can also be seen. Attached to the upper print frame 36 are a bracket 54 having a print head 52 moveably coupled thereto and a ribbon cartridge 50. The ribbon cartridge 50 includes a supply spool 56 and a take-up spool 58 that can have a ribbon (not shown), such as an ink ribbon, extending therebetween. The ribbon cartridge 50 may be selectively driven by a gear train 44 or another motive element to feed the ribbon between the two spools 56, 58.

The print head 52 is located between the two spools 56, 58 such that the ribbon passes across the print head 52 for a printing process, such as, for example, thermal transfer printing in which the ink on the ribbon is selectively melted to the print media. If the print head is a thermal transfer print head, then the print head 52 may include heating elements allowing for the selective heating of the print head 52, associated control circuitry, a heat sink for the dissipation of the heat from the print head 52, and the like.

Figure 4:
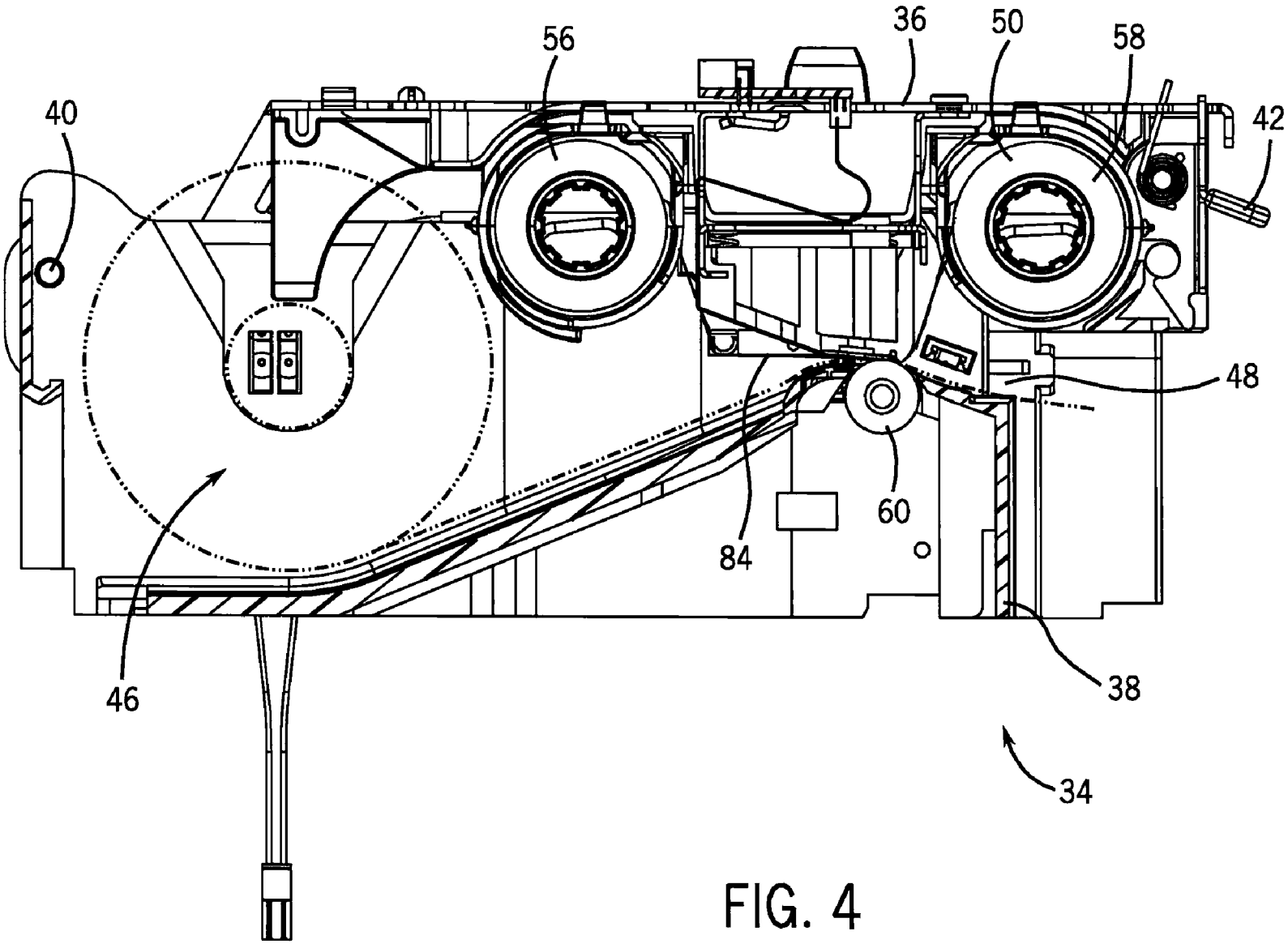
FIG. 4 is a cross-sectional view along line 4-4 of FIG. 2.

Referring now to FIG. 4, a cross-sectional view of the print assembly 34 is shown with the print assembly 34 in the closed position and the print media fed through the print assembly 34 in phantom lines. As can be seen in this view, when the print assembly 34 is closed, the print head 52 is biased away from the bracket 54 to apply pressure across a platen roller 60 located in the lower print frame 38. When the print media on the roll assembly 46 and the ribbon are fed between the print head 52 and the platen roller 60 by the rotation of the platen roller 60, the print head 52 applies a pressure across the ribbon and print media and can be selectively heated to transfer the ink on the ribbon to the print media. After the media has been printed on, the media is fed out a slot 48 located on the side of the print assembly 34.

The gear train 44, mounted on the side of the lower print frame 38 and driven by a motor (not shown), drives the printing operation. Specifically, the gear train 44 drives the rotation of the platen roller 60 for feeding the media and the spools 56, 58 of the ribbon cartridge 50 for feeding the ribbon.

Due to the consumable nature of the printing process, many of the components in or attached to the print assembly 34 may be replaceable. For example, as the roll assembly 46 and the ribbon cartridge 50 are consumed during the printing process, it may be necessary to replace them from time to time. Thus, it may be beneficial to have easy access to the internal components of the print assembly 34.

The ribbon cartridge 50 has a gap 94 (seen in FIG. 5) between the two parallel spaced spools 56, 58 across which a ribbon 84 (as shown in FIG. 4) extends. As can be best seen in FIG. 4, when the ribbon cartridge 50 is loaded in the print assembly 34 the print head 52 is located between the spools 56, 58. In the loaded position, the ribbon 84 extends down from the supply spool 56, along a locating shaft on the print head 52, across a print face between the print head 52 and the platen roller 60 (where the ink transfer may occur), and back up into the take-up spool 58. As will be described in further detail below, the gear train 44 can drive the driving portions on one or the other of the spools 56, 58 to transfer the ribbon 84 from the spools 56, 58 to the other in forward-feed or rewind operations.

Figure 5:
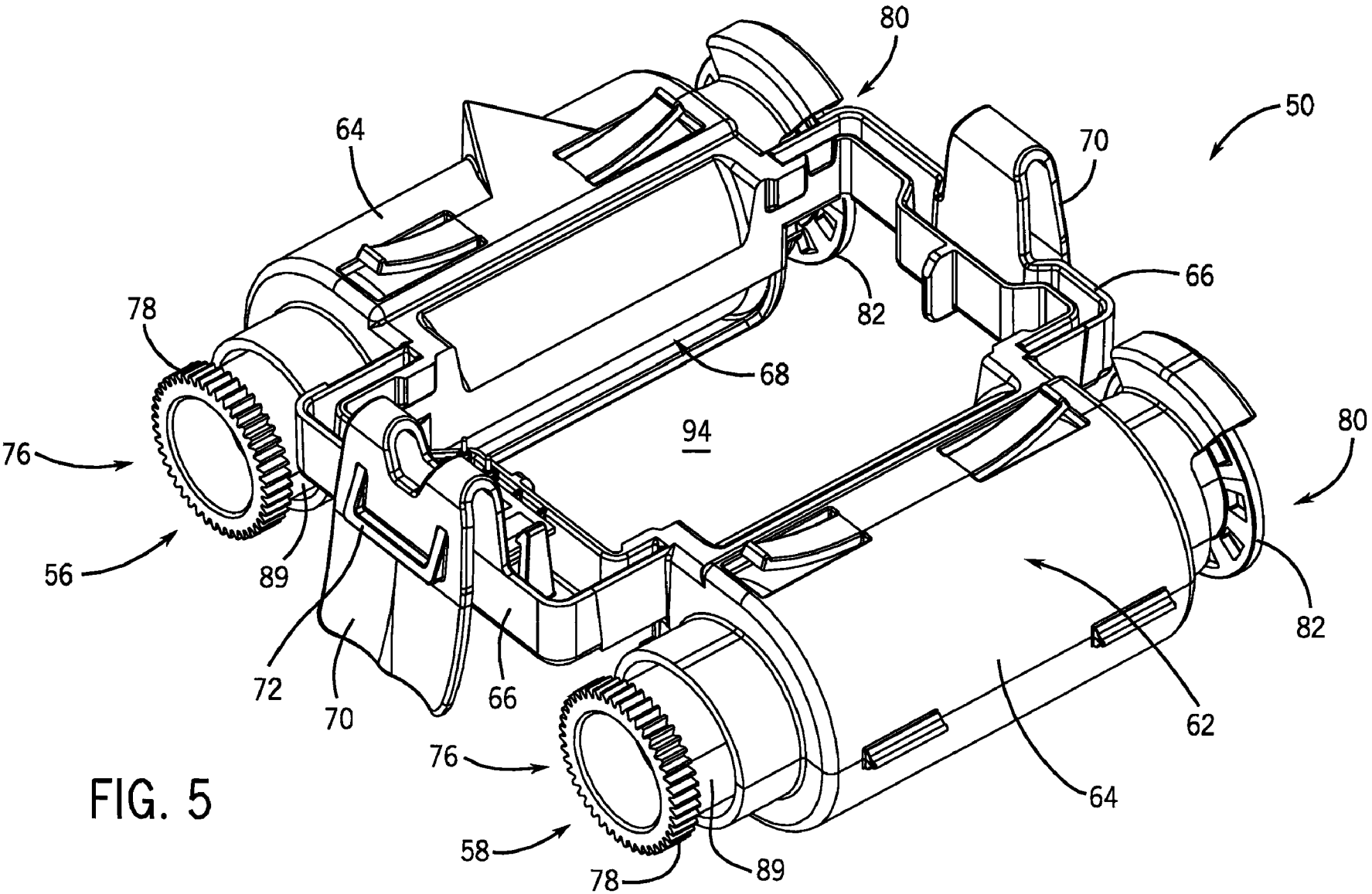
FIG. 5 is a front side perspective view of the ribbon cartridge.

Referring now to FIG. 5, the ribbon cartridge 50 can be seen separate from the rest of the print assembly 34. A housing 62 provides the general form of the ribbon cartridge 50. The housing 62 includes two hollow cylindrically-shaped portions 64 connected by two lateral sides 66 defining a space therebetween for the placement of the print head 52. The supply spool 56 is located within the more rear (relative to the direction of printing) of the two hollow cylindrically-shaped portions 64 of the housing 62 and the take-up spool 58 is located within the more forward of the two hollow cylindrically-shaped portions 64 of the housing 62. An aperture 68 is formed in each of the two hollow cylindrically-shaped portions 64 of the housing 62 such that the ribbon on the spools 56, 58 can be received on or dispensed from each of the spools 56, 58.

Each of the two lateral sides 66 have a clip 70 for releaseably attaching the ribbon cartridge 50 to the upper print frame 36. The clip 70 extends first upwardly and then downwardly and has a barbed projection 72 on the downwardly-extending portion. The clip 70 can be elastically bent inward during the reception of the ribbon cartridge 50 in the upper print frame 36 such that the barbed projection 72 catches on a slot or recess in the upper print frame 36 to retain the ribbon cartridge 50 in the upper print frame 36. To remove the ribbon cartridge 50 from the upper print frame 36, the downwardly-extending portion of the clip 70 can be pushed inward until a ledge on the barbed projection 72 has cleared the slot or recess on the upper print frame 36 so as to release the ribbon cartridge 50 from the upper print frame 36.

Figure 6:
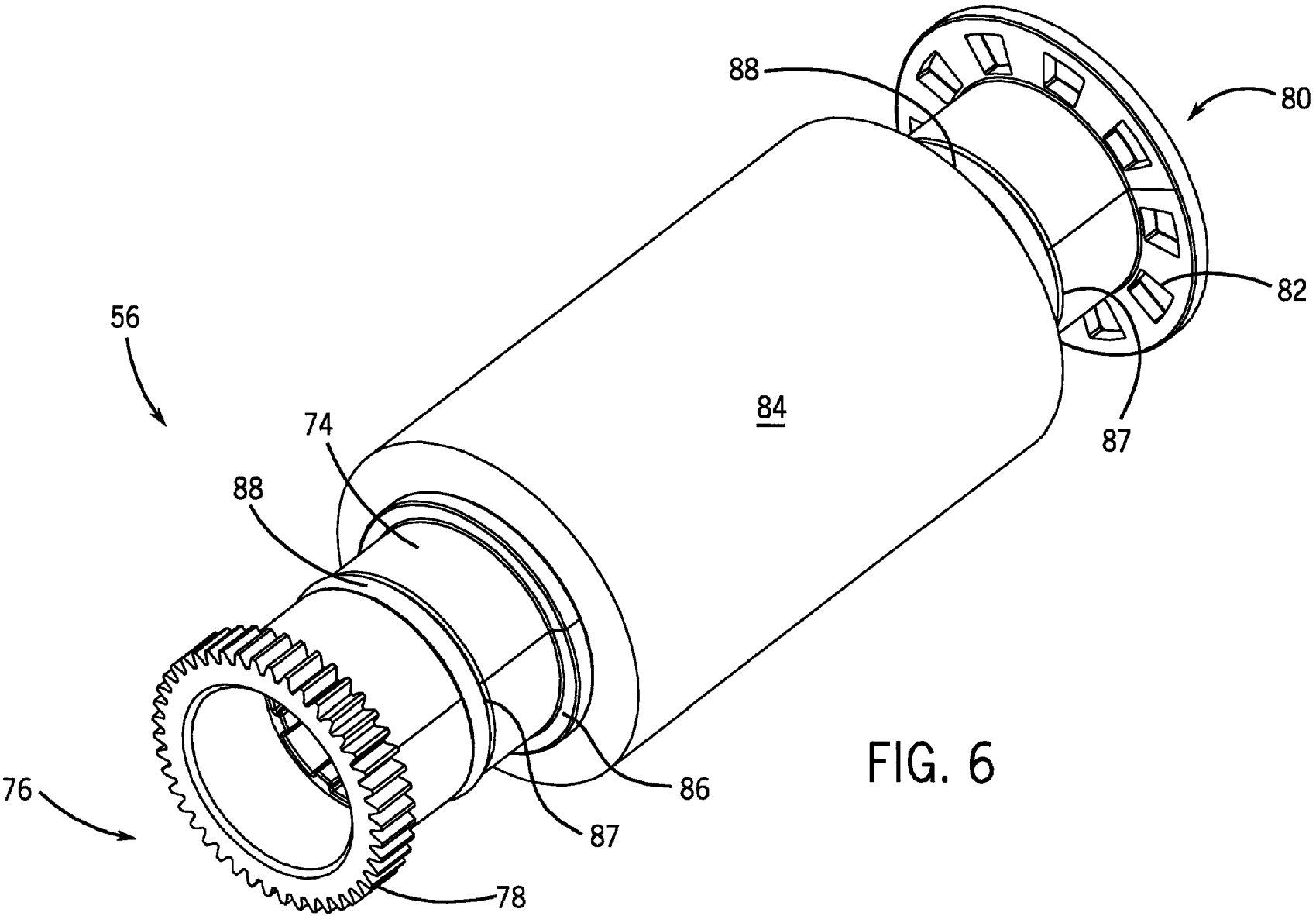
FIG. 6 is a front side perspective view of one of the spools removed from the ribbon cartridge.
Figure 7:
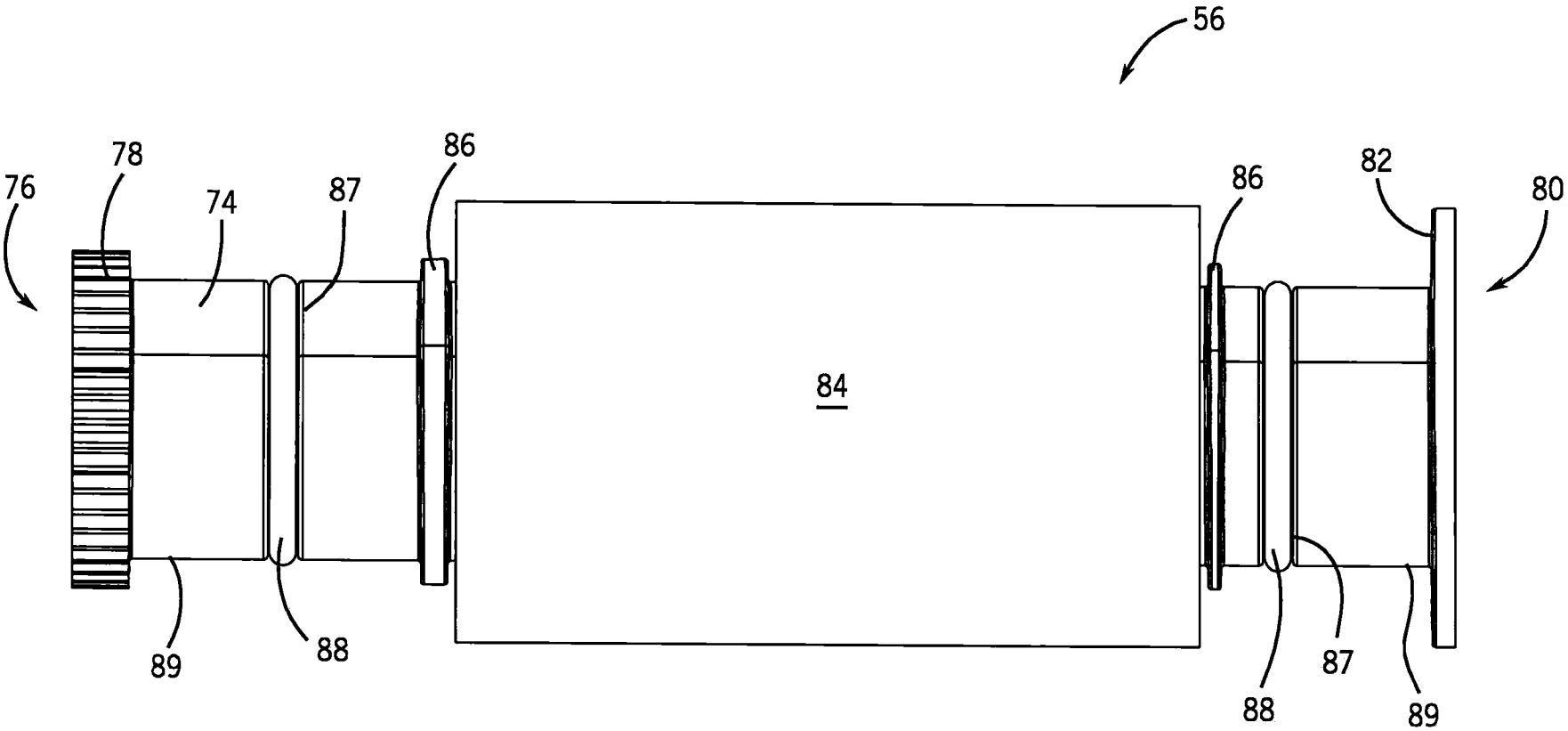
FIG. 7 is a plan side view of the spool of FIG. 6.

Referring now to FIGS. 6 and 7, the supply spool 56 is shown apart from the housing 62. The supply spool 56 and the take-up spool 58 are similar in structure and thus the general description of the supply spool 56 is applicable to the take-up spool 58.

The supply spool 56 includes a cylindrical body 74 extending from an end 76 having gear teeth 78 to an end 80 having an encoder wheel 82. A ribbon 84 can be circumferentially wound around the cylindrical body 74. The ribbon 84 is axially captured on both sides by flanges 86 that radially extend from the surface of the cylindrical body 74 of the spool 56.

Additionally, the supply spool 56 has o-rings 88 that are received in the surface of the cylindrical body 74. Two circumferential channels 87 are formed in the surface of the cylindrical body 74 for receiving the o-rings 88. One of the circumferential channels 87 is formed between the gear teeth 78 and the flange 86 proximal the gear teeth 78. The other of the circumferential channels 87 is formed between the encoder wheel 82 and the flange 86 proximal the encoder wheel 82. Into each of these channels 87 the o-rings 88 is secured such that the o-rings 88 extend out from the surface of the cylindrical body 74.

Figure 8:
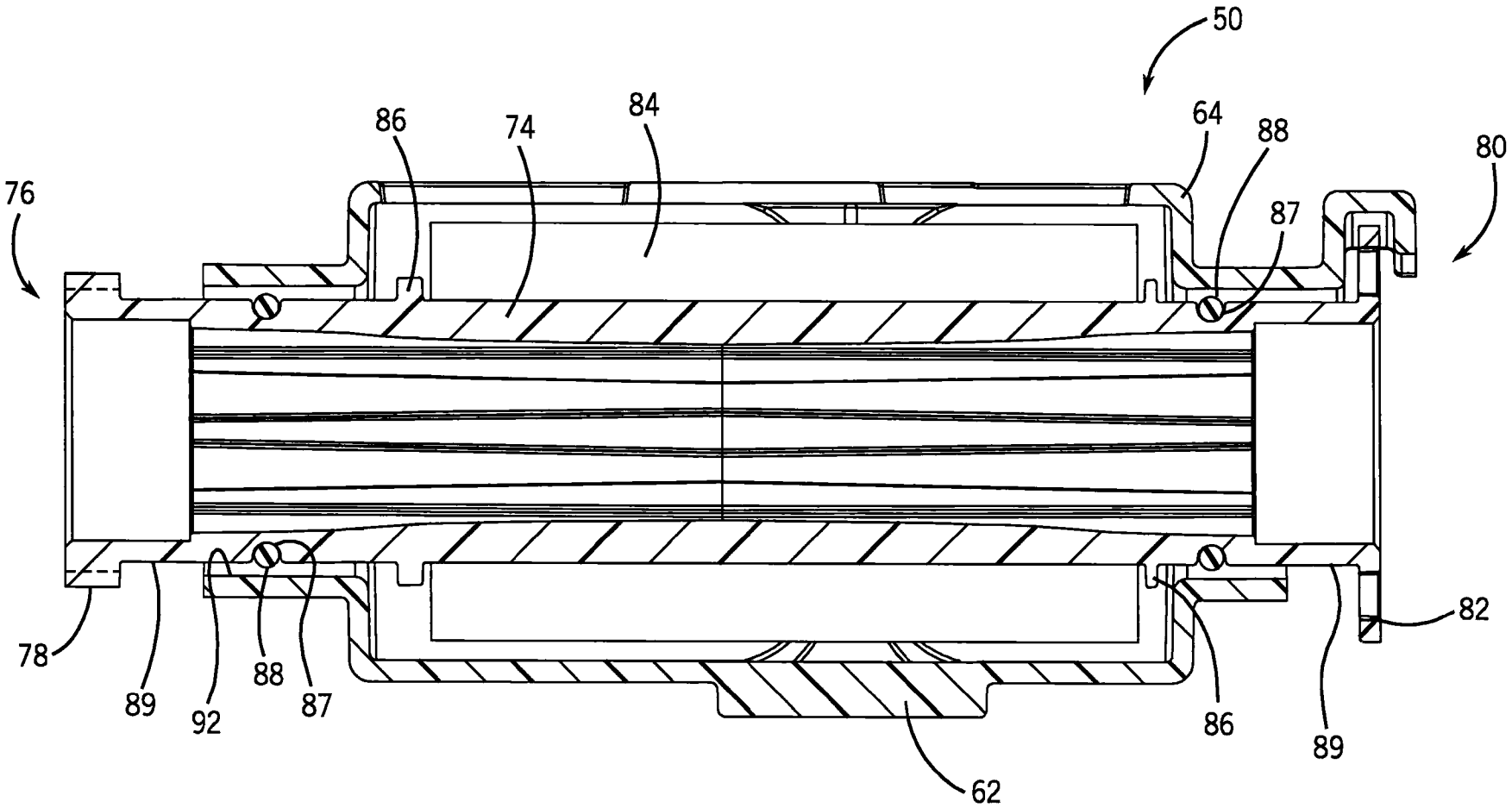
FIG. 8 is a cross-sectional side view of the spool floating within the cartridge housing.
Figure 9:
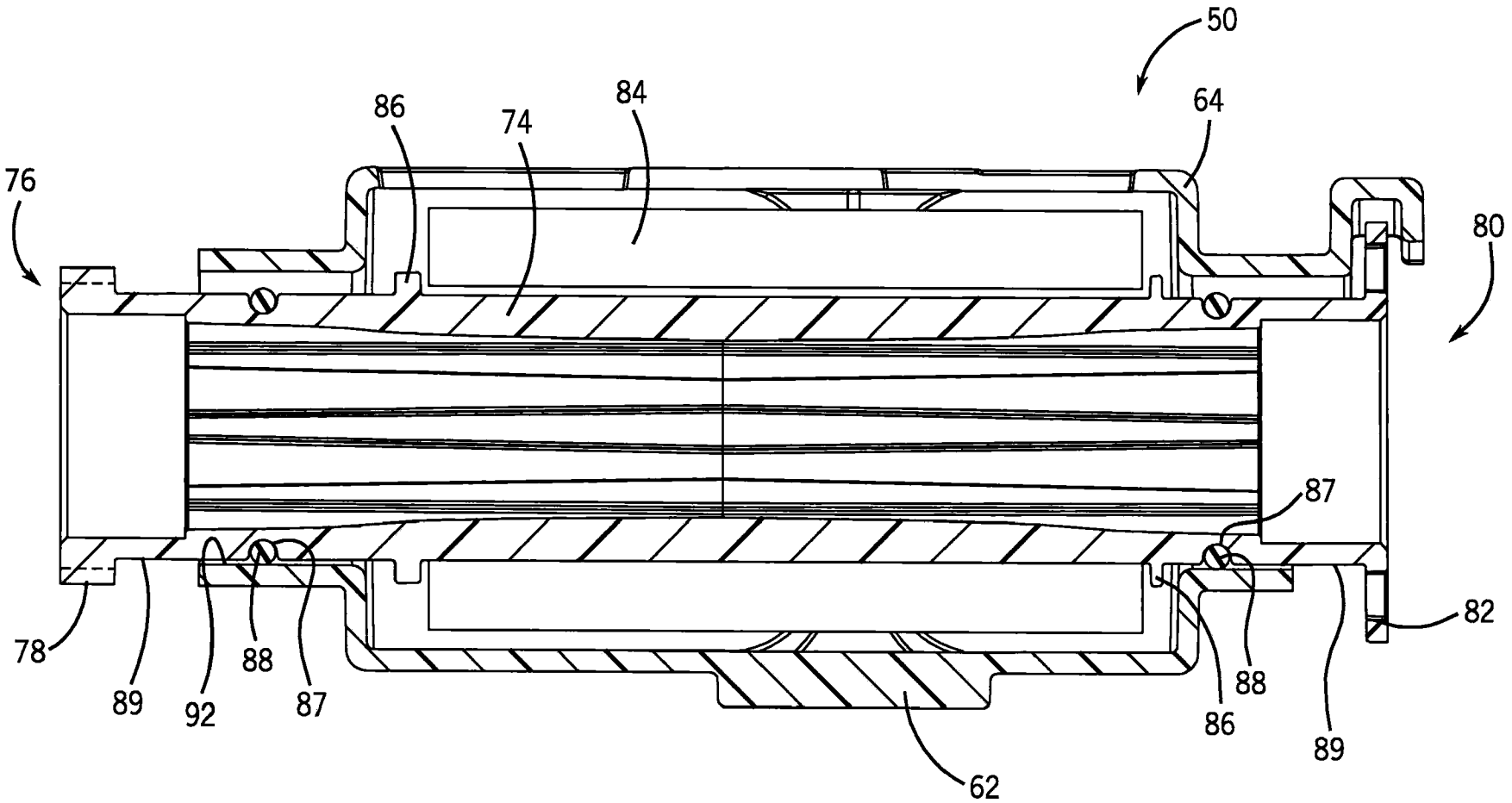
FIG. 9 is a cross-sectional side view of the spool dropped within the cartridge housing.

Referring now to FIGS. 8 and 9, the position of the spools 56, 58 within the housing 62 will depend on the state of the ribbon cartridge 50. The state of the ribbon cartridge 50 may be determined by structure external to the ribbon cartridge itself and, in particular, whether the ribbon cartridge 50 is loaded in the print assembly 34.

Figure 10:
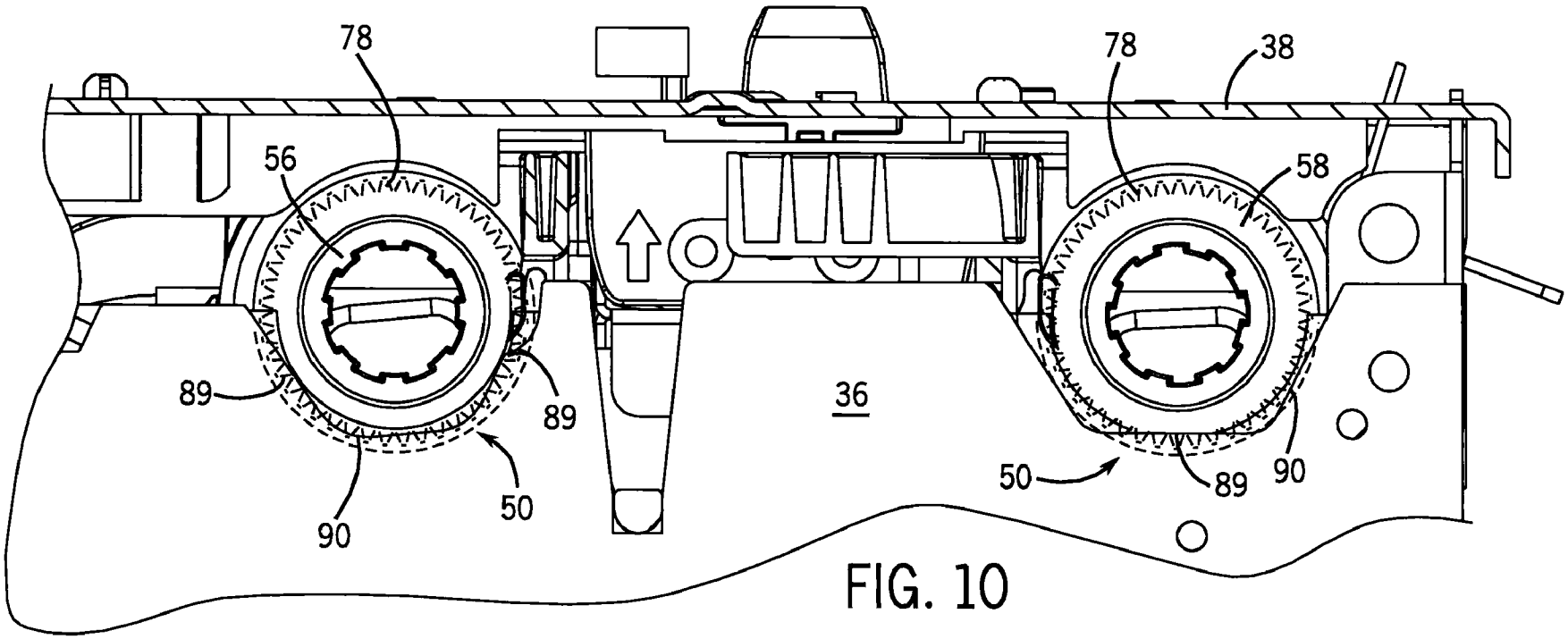
FIG. 10 is an environment view of the ribbon cartridge loaded within the print assembly such that the spools are lifted to float within the cartridge.

In one configuration, shown in FIG. 8, the spools 56, 58 float within the housing 62. As shown in FIG. 10, when the ribbon cartridge 50 is received in the upper print frame 36 and the upper print frame 36 is in the closed position (such that the upper print frame 36 is secured to the lower print frame 38), then exposed portions 89 of the cylindrical body 74 of the spools 56, 58 proximate the gear teeth 78 and the encoder wheel 82 will be located into grooves or saddles 90 formed in the lateral walls of the lower print frame 38. The saddles 90 support each of the ends 76, 80. As the ribbon cartridge 50 is secured in the upper print frame 36, the supporting of the ends of the spools 56, 58 lifts the spools 56, 58 such that the o-rings 88 do not contact an inner surface 92 of the housing 62.

In the floating or loaded configuration, the spools 56, 58 can be easily rotated by the gear train 44 that engages the gear teeth 78 of the spools 56, 58. The material and finish of the saddles 90 and the cylindrical body 74 of the spool 56, 58 are selected such there is little friction between the two. Thus, the interface of the saddles 90 and the cylindrical body 74 functions as bearing during a printing operation.

Between print jobs, the gear train 44 has a clutch or other tensioning mechanism that will prevent the floating spools 56, 58 from rotating. Thus, even when the spools 56, 58 are floating within the housing 62, the ribbon on the spools 56, 58 will not unwind when the spools 56, 58 are not being driven.

However, if the print assembly 34 is opened or the ribbon cartridge 50 is removed from the upper print frame 36, then the spools 56, 58 no longer float within the ribbon cartridge 50. In either of these states, gravity causes the spools 56, 58 to drop within the housing 62 such that the o-rings 88 contact the inner surface 92 of the housing 62.

In the dropped or unloaded state, the unwinding of the spools 56, 58 is prevented by frictional forces between the o-rings 88 and the inner surface 92 of the housing 62. The o-rings 88 are made of a material having a high coefficient of friction such as, for example, rubber. The material and finish of the housing 62 are then selected such that there will be strong frictional forces between the o-rings 88 and the inner surface 92 of the housing 62. These friction forces will prevent the spools 56, 58 from rotating within the housing 62 and the ribbon from unwinding.

Importantly, the housing 62 and the spools 56, 58 are formed such that there can be some clearance, although very minimal, between the o-rings 88 and the inner surface 92 of the housing 62. Some amount of clearance is desirable, such that the spools 56, 58 can float within the housing 62 for controlled unobstructed rotation. However, it is also desirable that the clearance be minimal, as when the spools 56, 58 drop within the housing 62, it preferable that spools 56, 58 are not easily shifted upon movement of the ribbon cartridge 50 since if the o-rings 88 were to temporarily float, the ribbon could unwind.

It should be appreciated that although o-rings 88 are described as providing resistance to spool 56, 58 rotation when the ribbon cartridge 50 is not loaded in the upper print frame 36, that the o-rings 88 could be replaced by any type of resistance-providing part. For example, a portion of the cylindrical body 74 could be overmolded with plastic or an elastomer having a sufficiently high coefficient of friction. Likewise, radially-extending teeth extending from the outer surface of the spools and the inner surface of the housing could produce a similar resistive effect. A raised adhesive or raised adhesive-backed rubber could also produce similar results.

Many modifications and variations to this preferred embodiment will be apparent to those skilled in the art, which will be within the spirit and scope of the invention. Therefore, the invention should not be limited to the described embodiment. To ascertain the full scope of the invention, the following claims should be referenced.

INDUSTRIAL APPLICABILITY

The invention provides a ribbon cartridge for printing that maintains ribbon tension when not being driven, but that does not require additional force to overcome the frictional force that maintains the tension.

What is claimed is:

1. A cartridge providing ribbon tension comprising:

a cartridge housing having walls including a base cartridge wall horizontally extending across a bottom side of the cartridge;

a first spool and a second spool contained at least in part in the cartridge, the first spool and the second spool extending between a pair of ends with at least one of the pair of ends having a driving portion;

a ribbon extending from the first spool to the second spool; and at least one resistance-applying part extending around a portion of each of the first spool and the second spool, such that each of the first spool and the second spool are movable between a loaded position in which the at least one resistance-applying part is disengaged from the walls of the cartridge and an unloaded position in which the at least one resistance-applying part engages the walls of the cartridge;

wherein a movement from the unloaded position to the loaded position occurs in a radial direction relative to an axis of rotation in each respective spool to lift the respective spool such that the resistance-applying part does not contact the base cartridge wall and wherein, when in the unloaded position, rotation of the respective spool is prevented by frictional engagement of the resistance-applying part with the base cartridge wall when the respective spool drops within the cartridge housing toward the bottom side of the cartridge.

2. A cartridge of claim 1, wherein the at least one resistance-applying part extending around a portion of each of the first spool and the second spool is a plurality of o-rings.

3. A cartridge of claim 2, wherein the first spool and the second spool each have two o-rings on opposite sides of a section of the first spool and the second spool for receiving the ribbon.

4. A cartridge of claim 2, wherein the first spool and the second spool have a plurality of retaining channels for receiving the plurality of o-rings.

5. The cartridge of claim 2, wherein the plurality of o-rings are composed of rubber.

6. The cartridge of claim 2, wherein the plurality of o-rings are composed of an elastomeric material.

7. The cartridge of claim 1, wherein the driving portion on at least one of the first spool and the second spool is a gear.

8. The cartridge of claim 1, wherein the first spool and the second spool are spaced to be adapted to receive a print head there between such that the print head can print using the ribbon extending between the first spool and the second spool.

9. The cartridge of claim 8, wherein the print head is a thermal print head and the ribbon is an ink ribbon for a thermal transfer printing operation.

10. The cartridge of claim 1, wherein the driving portion of at least one of the first spool and the second spool is adapted for engagement with a gear train to selectively drive the cartridge.

11. A printer comprising:

a print assembly frame including an upper print frame and a lower print frame movably coupled to one another;

a ribbon cartridge releaseably received into the upper print frame, the ribbon cartridge comprising:

a cartridge housing having walls including a base cartridge wall horizontally extending across a bottom side of the cartridge;

a first spool and a second spool contained at least in part in the cartridge, the first spool and the second spool extending between a pair of ends with at least one of the pair of ends having a driving portion;

a ribbon extending from the first spool to the second spool; and at least one resistance-applying part extending around a portion of each of the first spool and the second spool, such that each of the first spool and the second spool are movable between a loaded position in which the at least one resistance applying part is disengaged from the base cartridge wall to permit rotation of the respective spool and an unloaded position in which the at least one resistance-applying part engages the base cartridge wall to inhibit rotation of the respective spool;

saddles each having a bearing surface formed in the lower print frame;

wherein, when the upper print frame and the lower print frame are closed, the saddles support the ends of the first spool and the second spool to lift the first spool and the second spool from the base cartridge wall to the loaded position within the printer.

12. The printer of claim 11, wherein a movement from the unloaded position to the loaded position lifts the respective spool such that the resistance-applying part does not contact the walls of the cartridge housing and wherein, when in the unloaded position, rotation of the respective spool is prevented by frictional engagement of the resistance-applying part with the walls of the cartridge housing.

13. The printer of claim 11, wherein the first spool and the second spool each have a respective axis of rotation and wherein movement between the loaded position and the unloaded position occurs in a radial direction relative to the respective axis of rotation.

* * * * *